United States Patent [19]

Inoue

[11] Patent Number: 4,562,019

[45] Date of Patent: Dec. 31, 1985

[54] METHOD OF PREPARING PLASTOMERIC MAGNETIC OBJECTS

[75] Inventor: Kiyoshi Inoue, Tokyo, Japan

[73] Assignee: Inoue-Japax Research Incorporated, Yokohama, Japan

[21] Appl. No.: 636,063

[22] Filed: Jul. 30, 1984

Related U.S. Application Data

[63] Continuation of Ser. No. 376,716, May 10, 1982, abandoned, which is a continuation of Ser. No. 123,488, Feb. 21, 1980, abandoned.

[30] Foreign Application Priority Data

| | | | |
|---|---|---|---|
| Feb. 23, 1979 | [JP] | Japan | 54-20356 |
| Feb. 27, 1979 | [JP] | Japan | 54-22366 |
| Feb. 27, 1979 | [JP] | Japan | 54-22367 |

[51] Int. Cl.[4] ..... B06B 1/02

[52] U.S. Cl. ..... 264/24; 252/62.54; 264/71; 264/72; 264/DIG. 58

[58] Field of Search ..... 264/24, DIG. 58, 71, 264/72; 252/62.54

[56] References Cited

U.S. PATENT DOCUMENTS

| | | | |
|---|---|---|---|
| 2,849,312 | 8/1958 | Peterman | 264/24 |
| 2,964,793 | 12/1960 | Blume | 264/24 |
| 2,999,275 | 9/1961 | Blume | 264/DIG. 58 |
| 3,066,355 | 12/1962 | Schloemann et al. | 264/24 |
| 3,249,658 | 3/1966 | Hodges et al. | 264/DIG. 58 |
| 3,333,333 | 8/1967 | Noack | 264/DIG. 58 |

FOREIGN PATENT DOCUMENTS

| | | | |
|---|---|---|---|
| 987487 | 4/1976 | Canada | 252/62.54 |
| 53-13906 | 2/1978 | Japan | 252/62.54 |
| 54-11498 | 1/1979 | Japan | 252/62.54 |
| 870573 | 6/1961 | United Kingdom . | |
| 883090 | 11/1961 | United Kingdom . | |
| 1102968 | 2/1968 | United Kingdom | 252/62.54 |
| 1190636 | 5/1970 | United Kingdom . | |
| 1196228 | 6/1970 | United Kingdom . | |
| 1299490 | 6/1970 | United Kingdom . | |
| 1447264 | 8/1976 | United Kingdom | 264/24 |
| 1449145 | 9/1976 | United Kingdom . | |
| 1506053 | 4/1978 | United Kingdom . | |
| 1531317 | 11/1978 | United Kingdom . | |

*Primary Examiner*—James Derrington

*Attorney, Agent, or Firm*—Karl F. Ross; Herbert Dubno

[57] ABSTRACT

A method of preparing an elastically deformable magnetic object in which fine metal particles treated with a settable organic substance are mixed with a rubber material in a pulverized form to make a powdery mass. This is shaped under pressure, in a magnetic field into a compacted body and heated followed by cooling to allow the powder particles of rubber materials to bond to the magnetic particles and join them together to yield a homogeneous elastically deformable metal object with the magnetic particles uniformly distributed therein.

8 Claims, 1 Drawing Figure

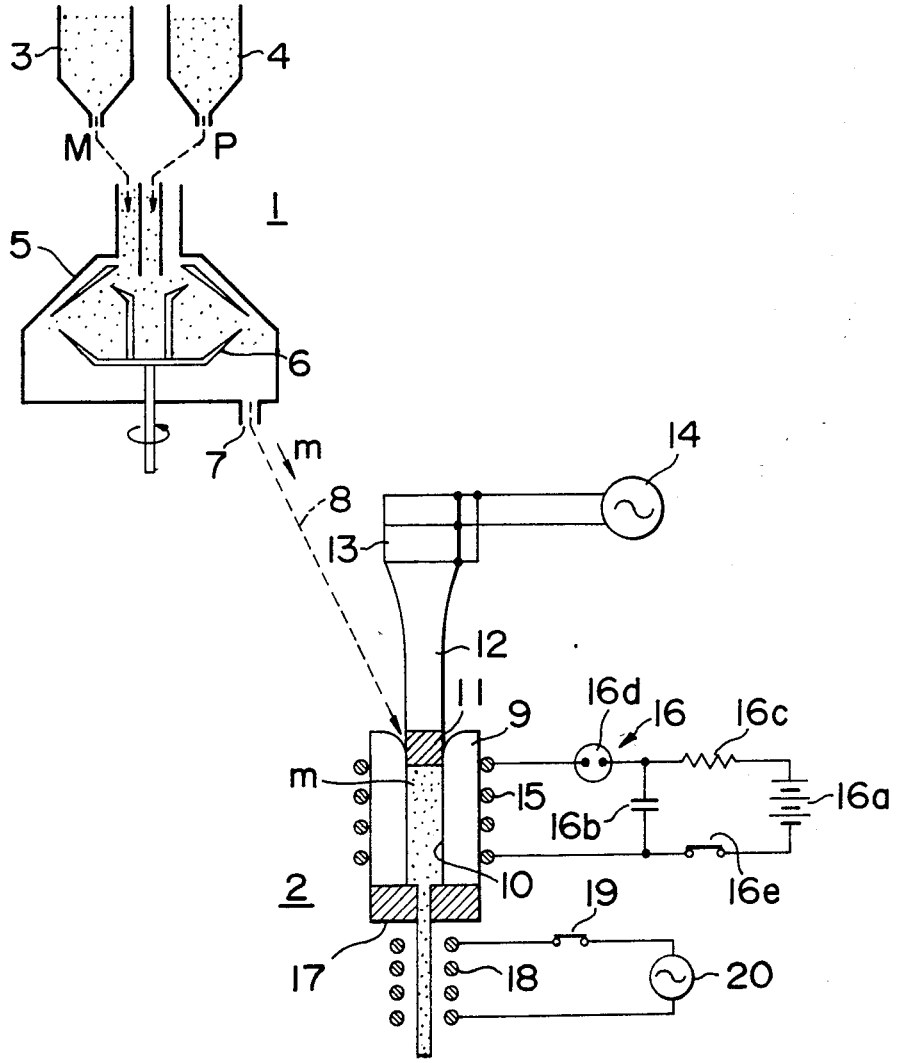
3
4
M
P
1
5
6
7
m
8
14
13
12
11
9
16d
16
16c
m
15
16a
16b
2
10
16e
19
17
18
20

METHOD OF PREPARING PLASTOMERIC MAGNETIC OBJECTS

CROSS REFERENCE TO RELATED APPLICATIONS

This applicaion is a continuation of Ser. No. 376,716 filed May 10, 1982 which, in turn, was a continuation of Ser. No. 123,488, filed Feb. 21, 1980, both now abandoned.

FIELD OF THE INVENTION

The present invention relates to an elastomeric magnetic object, also known as magnetic elastomer, polymeric magnet, magnetic rubber and rubber magnet, useful as a buffer or shock-absorbing articles exhibiting magnetism and a resilient or pressure-sensitive magnetic product. More particularly, the invention relates to an improved method of preparing an elastomeric magnetic object in which a pulverized magnetic material is combined with a binding polymeric material.

BACKGROUND OF THE INVENTION

Elastomeric magnetic objects have heretofore been prepared by combining a pulverized magnetic material with an elastomeric material such as a rubber or synthetic resin in a semi-liquid, fluidity state to form a mixture which is loaded in a kneading machine. The mixture unloaded from the latter is then shaped into a predetermined size and form by extrusion or pressing, followed by vulcanizion to yield a desired object. In such conventional preparation techniques, a satisfactory, uniform mixing of magnetic particles and boding elastomeric material could not be attained. Thus, in the resulting product, magnetic particles distribute rather irregularly in the supporting elastomeric material which also serves to only loosely carry the distributed magnetic particles. The attempt to increase the strength at which the particles are distributorily held has resulted in the requirement for a larger amount of the elastomeric material. Because of this and the lack of uniformity of distribution of magnetic particles in the supporting elastomeric material, magnetic properties attainable heretofore with elastomeric magnetic objects have been undesirably limited.

OBJECTS OF THE INVENTION

It is, accordingly, a principal object of the present invention to provide a method of preparing an elastomeric magnetic object, which enables the object to develop improved magnetic properties.

Another object of the invention is to provide a method which allows an elastomeric magnetic object to be prepared which has magnetic particles uniformly distributed in the supporting elastomeric material with a greater bonding strength therebetween than that attainable heretofore.

A further object of the invention is to provide a method which allows an elastomeric magnetic object to exhibit superior product performance with regard to both magnetic properties and mechanical strength.

SUMMARY OF THE INVENTION

In accordance with the present invention there is provided a method of preparing an elastomeric magnetic object, comprising the steps of: (a) mixing at a preselected proportion a polymerizable elastomeric material in a pulverized form and a magnetic material in a pulverized form together to form a mass of the mixture thereof, (b) shaping the mass under pressure in a magnetic field into a body of a preselected configuration and size; and (c) vulcanizing the body to yeild the elastomeric magnetic object.

In accordance with the invention, elastomeric objects of magnetically soft, hard and semi-hard characteristics are equally prepared as desired. For example, a pulverized material of magnetically hard characteristics of a class including manganese-aluminum (Mn-Al) alloys, rare-earth magnetic alloys such as samarium-cobalt ($SmCo_5$, $Sm_2Co_{17}$) alloys, iron chromium-cobalt (Fe-Cr-Co) alloys and barium-ferrite compositons may be used for preparation of an elastomeric magnetic object of "hard" characteristics. An elastomeric object of magnetically soft characteristics makes use of a pulverized magnetically soft characteristics which may be of a class including iron-silicon-abuminum (Fe-Si-Al) compositions and permalloys. A material composed and treated to possess semihard magnetic characteristics, e.g. iron-chromium-cobalt (Fe-Cr-Co) alloys, iron-copper-nickle (Fe-Cu-Ni) alloys, and pulverized is used to constitute the magnetic material.

The elastomeric material may be constituted by a polymeric substance such as natural rubber, styrene-butadiene-rubber (SBR), neoprene, polybutadiene or silicone rubber. In accordance with the present invention, any one or a combination of such polymeric substances (which have commonly been used as rubbers) in a solid form and a desired magnetic material each are preferably rendered brittle by cooling to a low temperature and then pulverized into fine particles, preferably of a uniform particle size, by loading into, say, an impact-pulverizing machine.

In accordance with an additional important feature of the present invention, magnetic particles are surface-treated, prior to mixing with the polymeric material, with an organic liquid substance adapted to cause the surfaces of magnetic particles to develop electric dipoles. Suitable liquid organic substances should have a good wettibility and, when set, a good bonding strength and include itaconic acid, acrylic acid, acrylic resin adhesive, lauric acid, liquid phenol, phenol-resorcinol and may also make use of any one of Chemlock (trade name and manufactured by Hughson Chemical Co., U.S.A.) or any one of Gemes (trade name and manufactured by Japax Fine Chemicals, Inc., Japan) series. Also suitable are, among others, NOBS (N-oxydiethylene-benzotiazylsulfenamid), a mixture of NOBS and TMTD (tetra-methylthiuramdisulfenamid), an RFL (resorcin-formalin-latex) compound, and a mixture of NaOH, RF resin (liquid), formalin, latex and a silane-coupling agents. Thus I treat a magnetic material in a pulverized (particulate) form with a settable liquid organic wetting agent. The coated particles thus also have a coating thereon in an unset state.

DESCRIPTION OF THE DRAWING

The sole FIGURE in the accompanying drawing is a schematic view partly in section diagrammatically illustrating an apparatus for carrying out the method according to the present invention.

SPECIFIC DESCRIPTION

The steps, features and advantages of the method embodying the present invention will be described hereinafter with reference to the accompanying drawing.

The apparatus illustrated basically comprises a mixing stage 1 and a forming stage 2. In the mixing stage 1, hoppers 3 and 4 supply a magnetic material M in a finely divided, powdery form and a polymeric material P likewise in a finely divided, powdery form, respectively, which are fed at a preselected proportion into a kneading machine 5 of conventional design including a rapidly revolving agitator blade arrangement 6. The kneading machine 5 thus causes the magnetic particles M and the polymeric particles P desirably proportioned in amounts to be uniformly mixed together to yield at its outlet 7, a mass m of the homogeneous combination of magnetic material M and polymeric material P. It is one important feature of the present invention that the polymeric material P is used in a finely divided, powdery form for mixing with magnetic particles M.

The mass m is then conveyed along a line 8, e.g. on a moving belt, to the forming stage 2 which here comprises a compaction and extrusion mold 9 adapted to receive the mass m in its cavity 10.

In the forming stage 2, a vertically movable punch 11 is positioned to penetrate slidably into the cavity 10 from the upper-end opening of the mold 9 to compress the mass m in the cavity under pressure applied downwardly by a press (not shown). The punch 11 shown here is a vibratory punch carried by a horn 12 having an electromechanical transducer 13 attached at its upper end, which is energized by a high-frequency power source 14 in a usual manner to impart to the punch 11 mechanical oscillations in a sonic or ultrasonic range.

In accordance with one important feature of the present invention, the mold 9 has a coil 15 wound therearound to apply a magnetic field to the mass m being compacted by the punch 11 in the cavity 10. It has been found that highly satisfactory results are obtained when this field is in the form of a pulsed magnetic field applied repetitively. The coil 15 is therefore preferably energized with a succession of impulsive currents furnished by a suitable pulsing source 16 which may comprise a DC source **16*a* and a capacitor 16*b* as shown. The capacitor 16*b* is charged by the DC source 16*a* via a resistor 16*c* to store a predetermined charge thereon. The discharge circuit for the capacitor 16*b* which connects it to the coil 15 is shown containing a switch 16*d* of breakdown type so that when the terminal voltage of the capacitor 16*b* exceeds the breakdown voltage, the switch 16*d* is rendered conductive and the charge on the capacitor 16*b* is impulsively discharged through the coil 15 which in turn causes an impulsive magnetic field to be generated through the mass m in the cavity 10. Thus, a succession of magnetic pulses are created through the mass m as long as an operating switch 16*c* in the charging circuit of the capacitor 16*b*** is closed.

The compaction and extrusion mold 9 is formed at its lower end with a die opening 7 through which the mass m in the cavity 10 is extruded. The mass m forced through and out of the die opening 17 is then passed through a heating coil 18 suppounding the region of its passage and energized via an operating switch 19 by a high-frequency power supply 20 for polyderization and vulcanization of the mass m to yield a desired magnetic elastomeric product.

The amounts of magnetic material M and polymeric material P proportioned at the inlet 3, 4 to the stage 1 depend upon the purposes of an elastomeric magnetic object to be produced. The magnetic material M supplied from the hopper 3 may be a mixture of two or more magnetic powders of different classes. The polymeric material P in the hopper 4 may and does typically incorporate one or more of vulcanizing and coloring agents as with usual rubber products. As mentioned previously, the polymeric material P is, in accordance with the present invention, prepared in the for of finely divided power or pulverization which has been found to yield a highly satisfactory homogeneous mixture in which magnetic particles M are uniformly distributed in the polymeric material P.

In order to attain an increased strength of bond between a magnetic particle M and polymeric particle P, it has further been found that the magnetic particle M should preferably be treated in advance in an organic solvent such as phenol or formalin, in a wetting liquid such as lauric acid or a derivative thereof or in an organic liquid adhesive such as acrylic resin, formaldehyde or polyvinyl resin emulsion to form an adherent film on the individual magnetic particles M. These substances more or less create electrical dipoles at their interfaces with the base polymeric material or magnetic material to establish adhesive bonding. Suitable examples of the treatment liquid also include any one of Chemlock series (trade name and available from Hughson Chemical Co., USA) and any one of Gemes series (trade names and available for Japax Fine Chemicals, Inc., Japan). Further, a liquid of N-oxy-diethylene-benzotiazylsulfenamid (NOBS), a mixture of NOBS and tetramethylthiuram disulfide (TMTD), resorcin-formalin, latex (RFL), or a mixture of sodium hydroxide, RF (resorcin-formalin) resin, formalin and latex have been found to be particularly satisfactory.

The reproducibility or uniform yield of products of a desired magnetic performance has been found to be markedly enhanced when the process incorporates the foregoing treatment step. This step also proves to enhance the magnetic properties of an elastomeric magnetic object produced since a lesser proportion of the polymeric material P relative to the magnetic material M can be used to provide the base or supporting structure of an excellent bond strength of polymeric material P. Thus, elastomeric magnetic objects superior both in magnetic and mechanical properties are obtained.

In the forming stage 2, the powder mass m of magnetic particles M and polymeric base material P uniformly combined in the first stage 1 is loaded in the cavity 10 of the mold 9 where it is compacted while being subjected to a strong magnetic field applied by the coil 15. In this case, the punch 11 and the lower end 17 of the mold 9 are constituted by a magnetically permeable material so that the field generated by the coil 15 is uniformly concentrated through the mass m in the cavity. Thus, a purposeful magnetic orientation of the material M in the body m is achieved. As described previously, the magnetic field is here applied in the form of a succession of magnetic impulses derived from the impulsive electrical source 16. By means of the pulsed field application, greater magnetic drive pressures and the resulting rapid change of the field gradient with time are repeatedly generated to facilitate the orientation of the magnetic particles M in the mass m. In addition, the punch 11 as equipped with the vibration arrangement 12, 13 and 14 applied to the mass m oscillatory mechanical impacts which, combined with the pulsed field application, serve to facilitate the mechanical and magnetic densification of the mass m.

EXAMPLE I

A finely divided powder of a Mn-Al family alloy of a particle size of 50 mesh is admixed with a finely divided phenol resin powder of 100 mesh at a proportion of 92% to 8% by volume. A mass of the mixture is then compacted under a magnetic field and extruded with an extrusion-molding apparatus as shown in the drawing and finally vulcanized. The resulting object has a maximum energy product of $3.2\times10^6$ Gauss-Oersted.

EXAMPLE II

The misture composed of the magnetic and phenol resin particles identical to those of EXAMPLE I has the magnetic particles which have, prior to mixting, been treated with a liquid of itaconic acid and individually coated with a film thereof. A mass of the mixture is similarly shaped and extruded in the magnetic field and vulcanized to yield a product which has a miximum energy product of $3.5\times10^6$ Gauss-Oersted. The product has a sufficient mechanical strength when the amount of the polymeric component is reduced to 4% by volume.

EXAMPLE III

The liquid of itaconic acid in EXAMPLE II is replaced by a liquid of phenol resolsin. The product has a maximum energy product of 3.9 to $4\times10^6$ Gauss-Oersted. The product has a sufficient mechanical strength when the amount of polymeric component is reduced down to 3% by volume.

EXAMPLE IV

A finely divided powder of a Mn-Al family alloy having a particle size of 300 mesh is mixed with a powder of chloroprene rubber of a similar mesh at a proportion of 95% to 5 by volume, the mixture being then formed in the manner described previously in a magnetic field of 5 KOe to yield a product which has a maximum energy product of $2.8\times10^6$ Gauss-Oersted and a bonding strength of 6 $Kg/cm^2$.

EXAMPLE V

In EXAMPLE IV, the magnetic particles are, prior to mixing, treated in a Chemlock liquid adhesive and coated with a film thereof. The resulting product has a maximum energy product of $3.1\times10^6$ Gauss-Oerated and a bonding strength of 8.8 $Kg/cm^2$.

EXAMPLE VI

In EXAMPLE V, the Chemlock liquid adhesive incorporates 5% by weight lauric acid. The product has a maximum energy product of $3.3\times10^6$ Gauss-Oersted and a bonding strength of 11.4 $Kg/cm^2$.

EXAMPLE VII

In EXAMPLE V, when the chloroprene rubber proportion is reduced so that the product may satisfy a bonding strength of 6 $Kg/cm^2$, it holds a maximum energy product of $3.3\times10$ Gauss-Oersted without change.

EXAMPLE VIII

In EXAMPLE VI, when the chloroprene rubber proportion is reduced so that the product may satisfy a bonding strength of 6 $Kg/cm^2$, it holds a maximum energy product of $4.1\times10^6$ Gauss-Oersted without change.

EXAMPLE IX

A magnetic powder of $Sm_2$ (Co, Fe, Cu, Zn)$_{17}$ alloy having particle sizes ranging between 5 to 10 microns in an amount of 92% by volume is admixed with a phenol resin in an amount of 8% by volume. In the compaction and extrusion stage, when the mixture is subjected to a continuous DC magnetic field of 110K Oersted per 10 mm length thereof the product has a maximum energy product of $4.1\times10^6$ Gauss-Oersted.

EXAMPLE X

EXAMPLE IX is followed except that instead of applying the magnetic field continuously, the same field was applied intermittently ten times. The resulting product has a maximum energy product of $5.6\times10^6$ Gauss-Oersted.

EXAMPLE XI

EXAMPLE X is followed except that, during the pulsed-magnetic compaction and extrusion stage, ultrasonic vibrations of 28 kHz and 40 W are applied to the mass. The resulting product has a maximum energy product of $6.2\times10^6$ Gauss-Oersted.

There is thus provided a novel method which is capable of producing elastomeric magnetic objects having improved product performance.

What is claimed is:

1. A method of preparing an elastically deformable magnetic object, comprising the steps of:
   (a) treating a magnetic material in the form of fine magnetic particles with a settable liquid organic substance selected from the group which consists of itaconic acid, acrylic acid, acrylic resin adhesive, lauric acid, liquid phenol, phenol-resorcinol, N-oxydiethylene-benzothiazylsulfonamide, tetramethylthiuram disulfide, resorcin-formalin and silane compounds for polarizing the surfaces of the individual magnetic particles;
   (b) mixing in a preselected proportion the magnetic material treated in step (a) and in the form of individual magnetic particles having respective layers of said liquid organic substance coated thereon in an unset state with a rubber material selected from the group consisting of natural, SBR, neoprene, polybutadiene and silicone rubbers in a pulverized form to form a powdery mass of a uniform mixture thereof;
   (c) shaping said mass under pressure in a magnetic field into a compacted body of the powdery mixture of a predetermined configuration and size; and
   (d) heating followed by cooling said body to allow said powder particles of rubber material to join and said magnetic particles to be bonded together and to said joining rubber particles through the intermediary of said organic substance as set to yield the homogeneous, elastically deformable magnetic object with said magnetic particles uniformly distributed and firmly carried therein.

2. The method defined in claim 1 wherein said magnetic material is composed of at least one magnetically hard substance selected from the group which consists of rare-earth alloys, manganese-aluminum alloys, iron chromium-cobalt alloys and barium-ferrite alloys.

3. The method defined in claim 1 wherein said magnetic material is composed of at least one magnetically soft substance selected from the group which consists of iron-silicon-aluminum alloys and permalloys.

4. The method defined in claim 1 wherein said magnetic material is composed of at least one magnetically semi-hard substance selected from the group which consists of iron-chromium-cobalt alloys and iron-copper-nickel alloys.

5. The method defined in claim 1 wherein said magnetic material is composed of a combination of substances selected from the group which consists of rare-earth alloys, manganese-aluminum alloys, iron-chromium-cobalt alloys, barium-ferrite alloys, iron-copper-nickel alloys, iron-silicon-aluminum alloys and permalloys.

6. The method defined in claim 1 wherein prior to step (a), said magnetic material and said rubber material are rendered each in pulverized form by subjecting it to a low-temperature treatment to render the same brittle and mechanically pulverizing the so-treated material.

7. The method defined in claim 1 wherein said magnetic field is intermittently applied to said mass.

8. The method defined in claim 1 wherein, during step (c) high frequency mechanical oscillations are applied to said mass.

* * * * *